US008025785B2

(12) United States Patent
De Nora

(10) Patent No.: US 8,025,785 B2
(45) Date of Patent: Sep. 27, 2011

(54) ALUMINIUM ELECTROWINNING CELLS WITH INCLINED CATHODES

(75) Inventor: Vittorio De Nora, Veyras (CH)

(73) Assignee: Rio Tinto Alcan International Limited, Montreal (CA)

( * ) Notice: Subject to any disclaimer, the term of this patent is extended or adjusted under 35 U.S.C. 154(b) by 1153 days.

(21) Appl. No.: 10/488,359

(22) PCT Filed: Aug. 29, 2002

(86) PCT No.: PCT/IB02/03517

§ 371 (c)(1),
(2), (4) Date: Mar. 9, 2005

(87) PCT Pub. No.: WO03/023091

PCT Pub. Date: Mar. 20, 2003

(65) Prior Publication Data

US 2006/0054499 A1 Mar. 16, 2006

(30) Foreign Application Priority Data

Sep. 7, 2001 (WO) ..... PCT/IB01/01634

(51) Int. Cl.
*C25C 3/08* (2006.01)
*C25C 7/02* (2006.01)

(52) U.S. Cl. ..... 205/381; 204/243.1; 204/237; 204/280; 204/284

(58) Field of Classification Search ..... None
See application file for complete search history.

(56) References Cited

U.S. PATENT DOCUMENTS

| | | | | |
|---|---|---|---|---|
| 4,600,481 | A * | 7/1986 | Sane et al. | 205/382 |
| 5,368,702 | A * | 11/1994 | de Nora | 205/373 |
| 5,651,874 | A * | 7/1997 | de Nora et al. | 205/372 |
| 5,725,744 | A * | 3/1998 | de Nora et al. | 204/244 |

FOREIGN PATENT DOCUMENTS

| | | | |
|---|---|---|---|
| EP | 0126555 | A1 * | 11/1984 |
| WO | WO 00/40782 | A1 * | 7/2000 |

* cited by examiner

*Primary Examiner* — Harry D Wilkins, III
(74) *Attorney, Agent, or Firm* — Jayadeep R. Deshmukh

(57) ABSTRACT

A cell for the electrowinning of aluminium (50) from alumina dissolved in a molten electrolyte comprises a generally horizontal cell bottom (5), preferably aluminium-wettable, on which a pool of product aluminium (50) is collected from at least one electrically conductive cathodic element (10) having aluminium-wettable cathode surfaces (11). The cathodic element comprises an inclined cathodic wall (10) in the electrolyte (60) above the generally horizontal cell bottom (5). The cathodic wall (10) has an upwardly-oriented inclined face (11) that forms a sloping upper aluminium-wettable drained active cathode surface on which aluminium is produced and drains into the aluminium pool (50), and a downwardly-oriented inclined face (12) which is in contact with the molten electrolyte (60) and which overlies the aluminium pool (50). The aluminium pool (50) covers substantially the entire cell bottom (5) including underneath the cathodic wall (10). A return path for alumina-enriched electrolyte (60) towards a bottom end of the anode-cathode gap (40) may be provided behind the cathodic wall (10) along an inactive surface (12) thereof. The cell may be fitted with anodes (10) that are foraminate, e.g. an arrangement of spaced apart parallel rods, or solid plates.

20 Claims, 5 Drawing Sheets

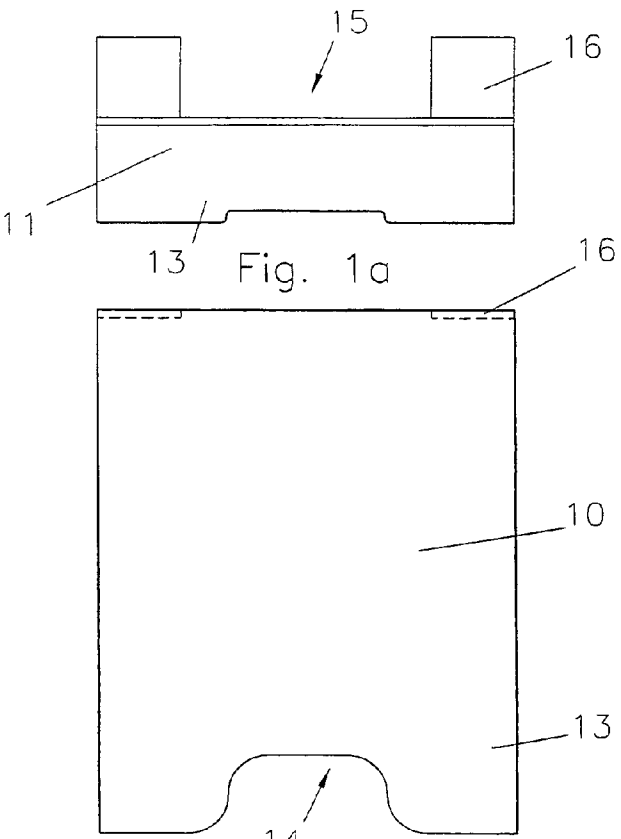
Fig. 1a
Fig. 1b
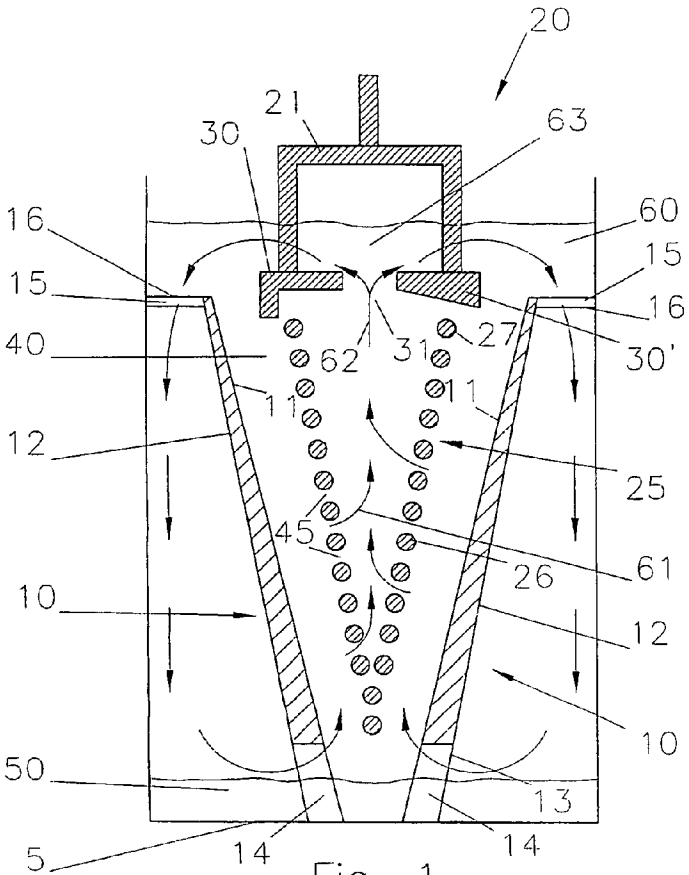
Fig. 1

ALUMINIUM ELECTROWINNING CELLS WITH INCLINED CATHODES

FIELD OF THE INVENTION

This invention relates to a cell for the electrowinning of aluminium from alumina provided with inclined aluminium-wettable drained cathodes.

BACKGROUND ART

The technology for the production of aluminium by the electrolysis of alumina, dissolved in molten cryolite containing salts, at temperatures around 950° C. is more than one hundred years old. This process and the cell design have not undergone any great change or improvement and carbonaceous materials are still used as electrodes and cell linings.

U.S. Pat. No. 3,400,061 (Lewis/Hildebrandt) and U.S. Pat. No. 4,602,990 (Boxall/Gamson/Green/Traugott) disclose aluminium electrowinning cells with sloped drained cathodes facing anodes sloping across the cell. In these cells, the molten aluminium flows down the sloping cathodes into a median longitudinal groove along the centre of the cell, or into lateral longitudinal grooves along the cell sides, for collecting the molten aluminium and delivering it to a sump.

In U.S. Pat. No. 5,362,366 (de Nora/Sekhar), a double-polar anode-cathode arrangement was disclosed wherein cathode bodies were suspended from the anodes permitting removal and reimmersion of the assembly during operation, such assembly also operating with a drained cathode.

U.S. Pat. No. 5,368,702 (de Nora) proposed a novel multimonopolar cell having upwardly extending cathodes facing and surrounded by or in-between anodes having a relatively large inwardly-facing active anode surface area. In some embodiments, electrolyte circulation was achieved using a tubular anode with openings.

U.S. Pat. No. 5,651,874 (de Nora/Sekhar) proposed coating components with a slurry-applied coating of refractory boride, which proved excellent for cathode applications. This publication discloses slurry-applied applications and novel drained cathode configurations, including designs where a solid cathode body with an inclined upper drained cathode surface is placed on or secured to the cell bottom.

U.S. Pat. No. 5,472,578 (de Nora) discloses an aluminium production cell comprising a grid on the cell bottom for restraining motion of the aluminium pool on the cell bottom. In some embodiments, the top end of the grid forms an aluminium-wettable drained cathode surface under an active anode surface.

WO00/40782 (de Nora) discloses aluminium production anodes with a series of coplanar parallel elongated anode members which are spaced-apart by flow-through openings and which form an electrochemically active surface. In one embodiment two downwardly converging spaced apart adjacent anodes can be arranged between a pair of substantially vertical cathodes. The adjacent anodes are spaced apart by an electrolyte down-flow gap in which alumina-rich electrolyte flows downwards until it circulates via the adjacent anodes' flow-through openings into the inter-electrode gaps.

WO01/31088 (de Nora) discloses aluminium electrowinning cells with solid anodes having a V-shaped active surface facing sloping cathodes. The anodes and cathodes are associated with vertical passages for the circulation of alumina-rich electrolyte to a bottom part of the inter-electrode gaps spacing the anodes and cathodes.

While the foregoing references indicate continued efforts to improve cell operations, none suggests the invention and there have been no entirely acceptable proposals for improving the cell efficiency, and at the same time facilitating the implementation of a drained cathode configuration with improved electrolyte circulation and large storage capacity of product aluminium.

OBJECTS OF THE INVENTION

It is an object of the invention to provide an aluminium electrowinning cell with an aluminium-wettable drained cathode of great working area and with a great aluminium storage capacity.

Another object of the invention is to provide a novel cathode design which can easily be retrofitted in existing conventional aluminium production cells.

A further object of the invention is to provide an aluminium production cell, in particular a retrofitted cell, with cathodes that can be replaced or serviced during cell operation.

Yet another object of the invention is to provide an aluminium production cell with low cost dimensionally stable aluminium wettable-drained cathodes.

A major object of the invention is to provide an aluminium electrowinning cell which generates less pollution than conventional Hall-Héroult cells.

SUMMARY OF THE INVENTION

The invention relates to a cell for the electrowinning of aluminium from alumina dissolved in a molten electrolyte. The cell comprises a generally horizontal cell bottom on which a pool of product aluminium is collected and at least one electrically conductive cathodic element having one or more sloping upper aluminium-wettable drained active cathode surfaces separated by an anode-cathode gap from one or more anodes with corresponding sloping active anode surfaces.

According to the invention, the cathodic element comprises an inclined cathodic wall in the electrolyte above the generally horizontal cell bottom. This cathodic wall has an upwardly-oriented inclined face that forms the sloping upper aluminium-wettable drained active cathode surface(s) on which aluminium is produced and drains into the aluminium pool, and a downwardly-oriented inclined face which is in contact with the molten electrolyte and which overlies the aluminium pool. The aluminium pool covers substantially the entire cell bottom including underneath the cathodic wall.

The cathodic wall can be placed into existing or new Hall-Héroult cells or into cells of new design providing the cells are fitted with sloping consumable or preferably non-consumable anodes. The cell bottom is preferably aluminium-wettable. It can be made of carbon, in particular carbon blocks, optionally coated with an aluminium-wettable material, for example as disclosed in U.S. Pat. No. 5,651,874 (de Nora/Sekhar), WO98/17842 (Sekhar/Duruz/Liu), WO01/42531 (Nguyen/Duruz/de Nora), WO01/42168 (de Nora/Duruz) and PCT/IB02/01932 (Nguyen/de Nora).

The cell according to the invention can be an entirely new cell or a retrofitted cell that comprises a cell bottom of a refurbished cell retrofitted with the above described anode structure and sloping cathode.

Such a cathode design on the one hand provides a great aluminium storage capacity and a great active cathode surface area, and on the other hand reduces the required cathodic material for producing cathodes having a sloping cathode surface.

The active cathode surface is usually at an angle between 15 deg. and up to nearly vertical, typically 85 deg. Such a cathode configuration advantageously has active cathode surfaces with a steep slope, i.e. above 45 deg., typically from 60 deg. to 80 deg.

This cathodic wall can comprise a generally flat plate. The plate can be uniformly planar or have a plurality of sloping sections, in particular in a v- or inverted v-shape arrangement in cross-section. Alternatively, the cathodic wall can be generally conical or pyramidal. Alternatively, the cathodic wall can made of a series of spaced apart generally parallel elongated cathodic members, such as bars, rods or blades. Each elongated member may be horizontal or at a slope, in particular extending along a vertical plane that is perpendicular to the sloping upper aluminium-wettable drained active cathode surface.

For instance, the cathodic wall has its bottom end on the cell bottom in the aluminium pool.

Alternatively, the cathodic wall may be suspended in the molten electrolyte. The cathodic wall may be suspended and spaced above the aluminium pool, in which case the cathodic wall is connected electrically above the electrolyte. Alternatively, the cathodic wall may be suspended and dip in the aluminium pool and can thus be electrically connected either above the electrolyte or through the aluminium pool.

Advantageously, the cathodic wall has a variable section that decreases with an increasing distance to the electrical cathodic connection such that the section is adapted to the decreasing amount of current that flows through the cathodic wall to maintain a substantially uniform current density throughout the cathodic wall.

When the cathodic wall is suspended in the electrolyte or when it can be otherwise accessed from above the electrolyte, for instance by having a part extending above the surface of electrolyte, it can be introduced into and removed from the cell during cell operation, i.e. without shutting down the cell.

Especially when the cathodic wall rests on the cell bottom or dips in the aluminium pool, it advantageously has a passage in a bottom part for the aluminium pool. This passage may also serve for a flow of alumina-rich electrolyte from behind the active cathode surface(s) to a bottom part of the anode-cathode gap.

The cathodic wall may also have an opening in a top part thereof for the flow of electrolyte from above an upper part of the anode-cathode gap to behind the active cathode surface(s). Alternatively, the cathodic wall can have an upper end that delimits a passage for the flow of electrolyte from above an upper part of the anode-cathode gap to behind the active cathode surface(s).

In some embodiments, electrolyte circulating behind the cathode surface can enter the anode-cathode gap through openings in the cathode. When the cathodic wall is made of a series of spaced apart generally parallel elongated cathodic members, the circulation of electrolyte can be provided downwardly behind the elongated cathodic members and into the anode-cathode gap through passages between the elongated cathodic members.

The cathodic wall can be made of an aluminium-wettable openly porous ceramic or ceramic-based material which is mechanically and chemically resistant and which is filled with molten aluminium.

Suitable ceramic-based materials that are substantially resistant and inert to molten aluminium include oxides of aluminium, zirconium, tantalum, titanium, silicon, niobium, magnesium and calcium and mixtures thereof, as a simple oxide and/or in a mixed oxide, for example an aluminate of zinc (e.g. $ZnAlO_4$) or titanium (e.g. $TiAlO_5$). Other suitable inert and resistant ceramic materials can be selected amongst nitrides, carbides and borides and oxycompounds thereof, such as aluminium nitride, AlON, SiAlON, boron nitride, silicon nitride, silicon carbide, aluminium borides, alkali earth metal zirconates and aluminates, and their mixtures.

Preferably, the aluminium-wettable openly porous walls contain an aluminium-wetting agent. Suitable wetting agents include metal oxides which are reactable with molten aluminium to form a surface layer containing alumina, aluminium and metal derived from the metal oxide and/or partly oxidised metal, such as manganese, iron, cobalt, nickel, copper, zinc, molybdenum, lanthanum or other rare earth metals or combinations thereof, for instance as disclosed in PCT/IB02/00668 (de Nora).

Further suitable materials for producing the openly porous walls are described in U.S. Pat. No. 4,600,481 (Sane/Wheeler/Gagescu/Debely/Adorian/Derivaz).

The anodes can be made of carbon but are preferably made of oxygen evolving materials, in particular metal-based materials, such as surface oxidised alloys. The anodes can also be made of materials active for the oxidation of fluorine ions. Suitable metal-based anodes for the oxidation of oxygen ions or fluorine ions are disclosed in WO00/06802, WO00/06803 (both in the name of Duruz/de Nora/Crottaz), WO00/06804 (Crottaz/Duruz), WO01/43208 (Duruz/de Nora), WO01/42534 (de Nora/Duruz) and WO01/42536 (Duruz/Nguyen/de Nora). Further oxygen-evolving anode materials are disclosed in WO99/36593, WO99/36594, WO00/06801, WO00/06805, WO00/40783 (all in the name of de Nora/Duruz), WO00/06800 (Duruz/de Nora), WO99/36591 and WO99/36592 (both in the name of de Nora).

The oxygen-evolving anodes may be coated with a protective layer made of one or more cerium compounds, in particular cerium oxyfluoride, as disclosed in U.S. Pat. No. 4,614,569 (Duruz/Derivaz/Debely/Adorian), U.S. Pat. No. 4,680,094 (Duruz), U.S. Pat. No. 4,683,037 (Duruz) and U.S. Pat. Nos. 4,966,674, 4,966,674 (Bannochie/Sheriff), PCT/IB02/00667 (Nguyen/de Nora) and PCT/IB02/01169 (de Nora/Nguyen).

Suitable oxygen-evolving anodes may comprise an electrochemically active foraminate metallic anode structure for the evolution of oxygen. The foraminate anode structure has through-openings for the circulation of electrolyte therethrough and is grid-like or plate-like.

For example, the foraminate anode structure comprises a perforated plate or is made of a series of spaced-apart parallel elongated anode members, for instance as disclosed in WO00/40782 (de Nora). The anode members can be horizontal or at a slope, in particular generally extending along a vertical plane that is perpendicular to the cathode surface. Preferably the elongated anode members have a cross-section that is proportional to the anodic current passed therethrough, i.e. a decreasing cross-section with a decreasing amount of current, to maintain a substantially uniform current density along the anode members. For example, the elongated anode members are elongated plates or blades, or rods, bars or wires.

In one embodiment, the cell comprises at least one electrolyte guide member located above the foraminate anode structure for guiding the circulation of electrolyte.

For instance, the anode has an inclined plate-like or grid-like open anode structure which has a generally v-shaped configuration in cross-section and which faces a corresponding generally v-shaped active cathode surface. In such a case, one or more electrolyte guide members can be located above the v-shaped anode structure. These guide members conveniently extend over substantially the entire v-shaped anode structure for guiding an up-flow of alumina-depleted electrolyte from the anode through-openings to a location above the anode structure where the electrolyte is enriched with alumina and then sideways over and around an upper end of the generally v-shaped anode structure from where the alumina-enriched electrolyte is fed into the anode-cathode gap. The cell may be so arranged that at least part of the alumina-enriched electrolyte is fed into an upper end of the anode-cathode gap and/or circulated outside and around the anode-cathode gap and directed towards a lower end thereof.

A suitable v-shaped anode structure comprises a series of horizontal or sloping elongated anodes members, for instance as described above, each having an elongated surface which is electrochemically active for the evolution of oxygen. The anode members are connected to one another, usually by at least one connecting member for example as disclosed in WO00/40782 (de Nora). The elongated anode members are generally parallel to one another and in a generally v arrangement in cross-section to form the electrochemically active surface that has a generally v-shaped cross-section. The anode members are spaced apart from one another by inter-member gaps that form the through-passages.

Another suitable anode comprises an electrochemically active metallic anode structure made of one or more solid plates facing an active cathode surface. This electrochemically active metallic anode structure may have an upper end that delimits a passage for the circulation of electrolyte above the anode structure or, alternatively, a passage in its upper part for the circulation of electrolyte through the anode structure.

The anode plates may be flat and have a uniformly planar sloping active part or several sloping active parts, for instance in a generally v-shaped or inverted v-shaped cross-sectional arrangement. Suitable anode plate structures are disclosed in WO99/02764 (de Nora/Duruz).

To maintain a substantially uniform current density along the anode plates, they can have horizontal cross-section that is proportional to the anodic current passed therethrough, i.e. a decreasing horizontal cross-section with a decreasing amount of current.

The anodes may also be generally conical or pyramidal, for example as disclosed in U.S. Pat. No. 5,368,702 (de Nora), to fit correspondingly shaped cathode plates.

The invention also concerns a method of electrowinning aluminium in a cell as described above. The method comprises electrolysing in the anode-cathode gap alumina dissolved in the molten electrolyte to produce gas anodically and aluminium on the upwardly-oriented inclined active cathode surface(s) of the cathodic wall(S). The product aluminium drains from the active cathode surface(s) and is collected on the cell bottom in the aluminium pool.

Advantageous methods of operating the cell are disclosed in WO00/06802 (Duruz/de Nora/Crottaz), WO01/42535 (Duruz/de Nora), WO01/42536 (Duruz/Nguyen/de Nora) and PCT/IB02/01952 (Nguyen/de Nora).

BRIEF DESCRIPTION OF THE DRAWINGS

The invention will now be described by way of examples with reference to the schematic drawings, wherein:

FIG. 1 shows a cross-sectional view of a drained-cathode cell according to the invention with a foraminate generally v-shaped oxygen-evolving anode;

FIGS. 1*a* and 1*b* show a plan view and a front, view, respectively, of the cathode element shown in FIG. 1;

DETAILED DESCRIPTION

Figure 2:
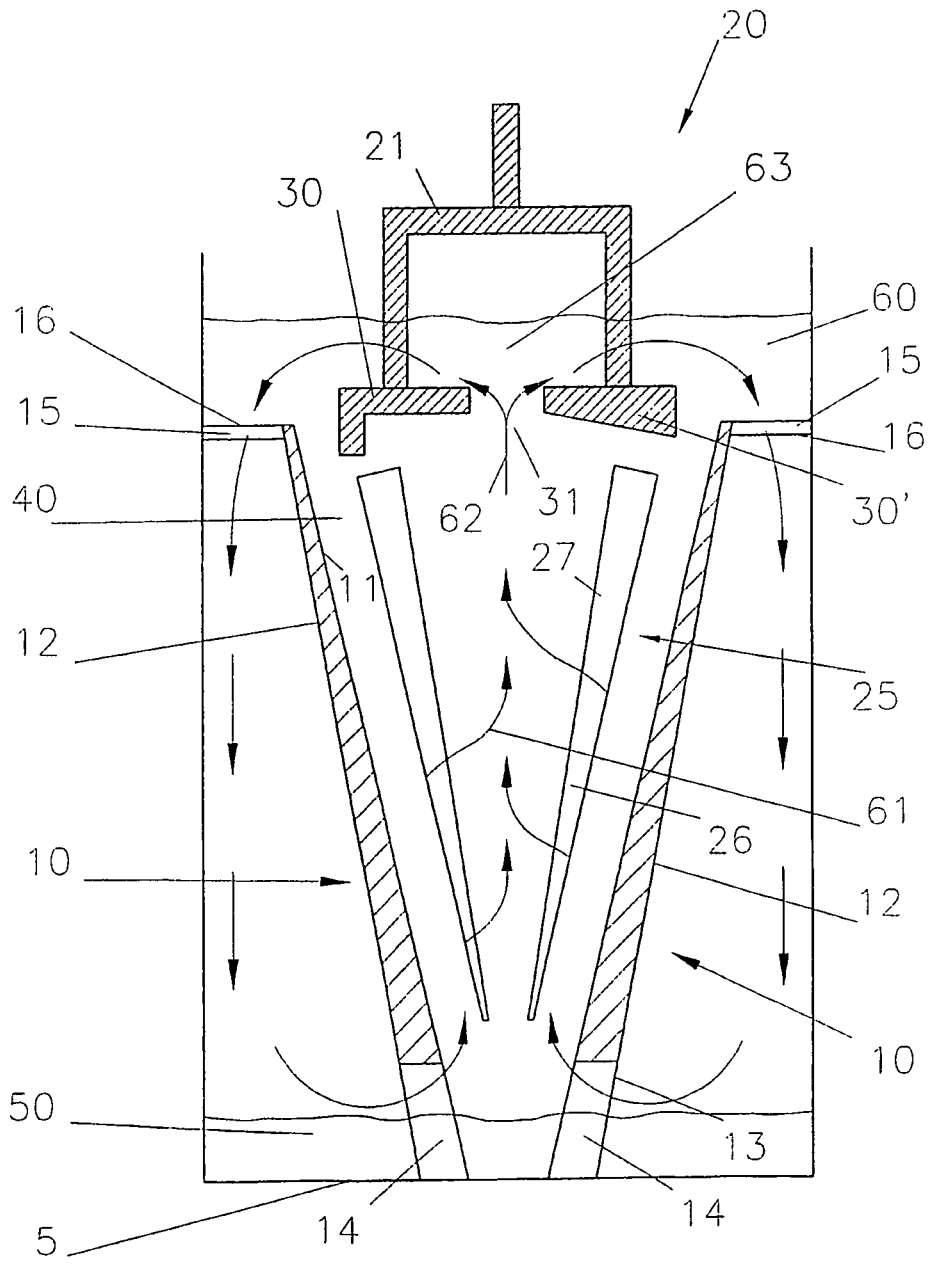
FIG. 2 shows a cross-sectional view of a drained-cathode cell according to the invention with another foraminate generally v-shaped oxygen-evolving anode.

FIG. 1 shows an aluminium production cell according to the invention having a horizontal cell bottom 5 covered with a pool of product aluminium 50. The cell has two inclined cathodic plates 10 in a molten electrolyte 60. Each plate 10 has an upwardly-orientated sloping aluminium-wettable drained cathode surface 11 separated by an anode-cathode gap 40 from a corresponding sloping active anode surface of an anode 20 having a v-shaped grid-like foraminate active structure 25 covered by an electrolyte guide member 30,30' shown with two possible shapes as discussed below.

The cathodic plates 10 also have a downwardly-orientated inclined rear face 12 in the electrolyte 60. This rear face 12 overlies the aluminium pool 50 that covers substantially the entire cell bottom 5. A bottom end 13 of the cathodic plates 10 rests on the cell bottom 5 in the aluminium pool 50 through which electrical current is passed from an external current supply to the cathodic plates 10. The section of cathodic plates 10 decreases with an increasing distance to the cathodic pool 50 so as to compensate for the current passed from the drained cathode surfaces 11 to the anodes 20 and provide a substantially uniform current density in plates 10 along substantially the entire height of plates 10.

As shown in FIGS. 1*a* and 1*b*, the cathodic plate 10 has a cut-out 14 in its bottom end 13 for passage of the aluminium pool 50 and for providing a return flow of alumina-enriched electrolyte 60 to the bottom end of the anode-cathode gap 40.

Furthermore, the cathodic plate 10 has at its upper end a pair of horizontally extending flanges 16 that space the active part of plate 10 from the sidewall of the cell. A passage 15 is provided between flanges 16 for the down-flow of alumina-enriched electrolyte 60 from above the upper end 27 of active anode structure 25 and then behind the drained cathode surface 11 to the lower end of the anode-cathode gap 40.

Instead of using plates with flanges that delimit an electrolyte passage, a substantially uniformly planar cathodic plate may be provided with an opening in its upper part or, alternatively, a substantially uniformly planar cathodic plate may be placed against one or more spaced apart protrusions extending from the cell sidewall or against a recess in the sidewall at the level of the upper part of the cathodic plates.

The cathodic plate 10 is made of aluminium-wettable openly porous material that is mechanically and chemically resistant and filled with molten aluminium, as described above.

The anode 20 is suspended in the electrolyte 60 by a yoke 21 with the downwardly-orientated active anode surface formed by the v-shaped grid-like foraminate structure 25 substantially parallel to the upwardly-oriented cathode surfaces 11. The v-shaped grid-like foraminate structure 25 is made of a series of parallel horizontal rods 26 (shown in cross-section) forming a downwardly-oriented generally v-shaped electrochemically active open anode surface. The anode rods 26 are electrically and mechanically connected through one or more cross-members (not shown), as disclosed in WO00/40782 (de Nora), and spaced apart from one another by inter-member gaps 45 that form passages for an up-flow 61 of alumina-depleted electrolyte 60. Alternatively, the v-shaped plate-like foraminate anode structure can be made of inclined rods in a v configuration (see FIG. 2) or a v-shaped perforated plate, such as an expanded metal mesh, or a pair of downwardly converging perforated plates.

The anode 20 comprises an electrolyte guide member 30,30' above the v-shaped grid-like anode structure 25 to guide all the up-flowing alumina-depleted electrolyte 62 through a central opening 31 in the guide member 30,30' to an alumina feeding area 63 where it is enriched with alumina, and then sideways over an upper end 27 of the anode structure 25 so that the alumina-enriched electrolyte 60 is mainly circulated through passage 15 at the top end of plate 10 and from there along the downwardly-orientated sloping surface 12 of plate 10 and then through the cut-out 14 in the bottom end 13 of plate 10 into a lower end of the anode-cathode gap 40. In this embodiment, a smaller part of the alumina-enriched electrolyte 60 is fed over the upper end 27 of the anode structure 25 into an upper end of the anode-cathode gap 40.

The geometry of the cell, in particular the section of the upper end of the anode-cathode gap 40 and of the passage 15, sets the ratio between the electrolyte 60 fed into the upper end of the anode-cathode gap 40 and the electrolyte 60 circulated through passage 15 to the lower end of the anode-cathode gap 40.

In the left-hand side of FIG. 1, the guide member 30 is shown in the shape of a horizontal plate with a downwardly extending peripheral flange. The right-hand side of FIG. 1 shows the guide member 30' with a sloping downwardly-orientated surface leading into the central opening 31. Other shapes are of course possible.

In a variation, the electrolyte guide member is dissociated from the anode.

During operation, alumina is electrolysed in the anode-cathode gap 40 and oxygen formed on the v-shaped grid-like foraminate structure 25 of the anode 20. The oxygen escapes upwardly through the gaps 45 promoting an upflow 61 of alumina-depleted electrolyte 60. The electrolyte up-flow is confined as indicated by arrow 62 by the electrolyte guide member 30,30' into the opening 31 and guided to the area 63 located thereabove where alumina is fed and enriches the circulating electrolyte 60. The alumina-enriched electrolyte 60 is then guided sideways and passes mainly behind the cathodic plate 10 into the lower end of the anode-cathode gap 40 with the remainder into the upper end of gap 40, as described above.

FIG. 2, where the same reference numerals designate the same elements, shows another cell according to the invention in which the generally v-shaped grid-like anode structure 25 is made of a series of parallel spaced-apart inclined rods 26, each rod extending along a vertical plane that is perpendicular to the aluminium-wettable drained cathode surface 11.

The spacing between inclined rods 26 forms a passage for the up-flow 61 of alumina-depleted electrolyte 61 sideways around rods 26.

To provide a uniform current distribution, each inclined rod 26 has a variable cross-section (the rods 26 being downwardly tapered) so as to compensate for the current passed to the drained cathode surface 11.

In a variation, the inclined anode rods 26 are substituted with other elongated anode members, for example bars, blades or plates.

Figure 3:
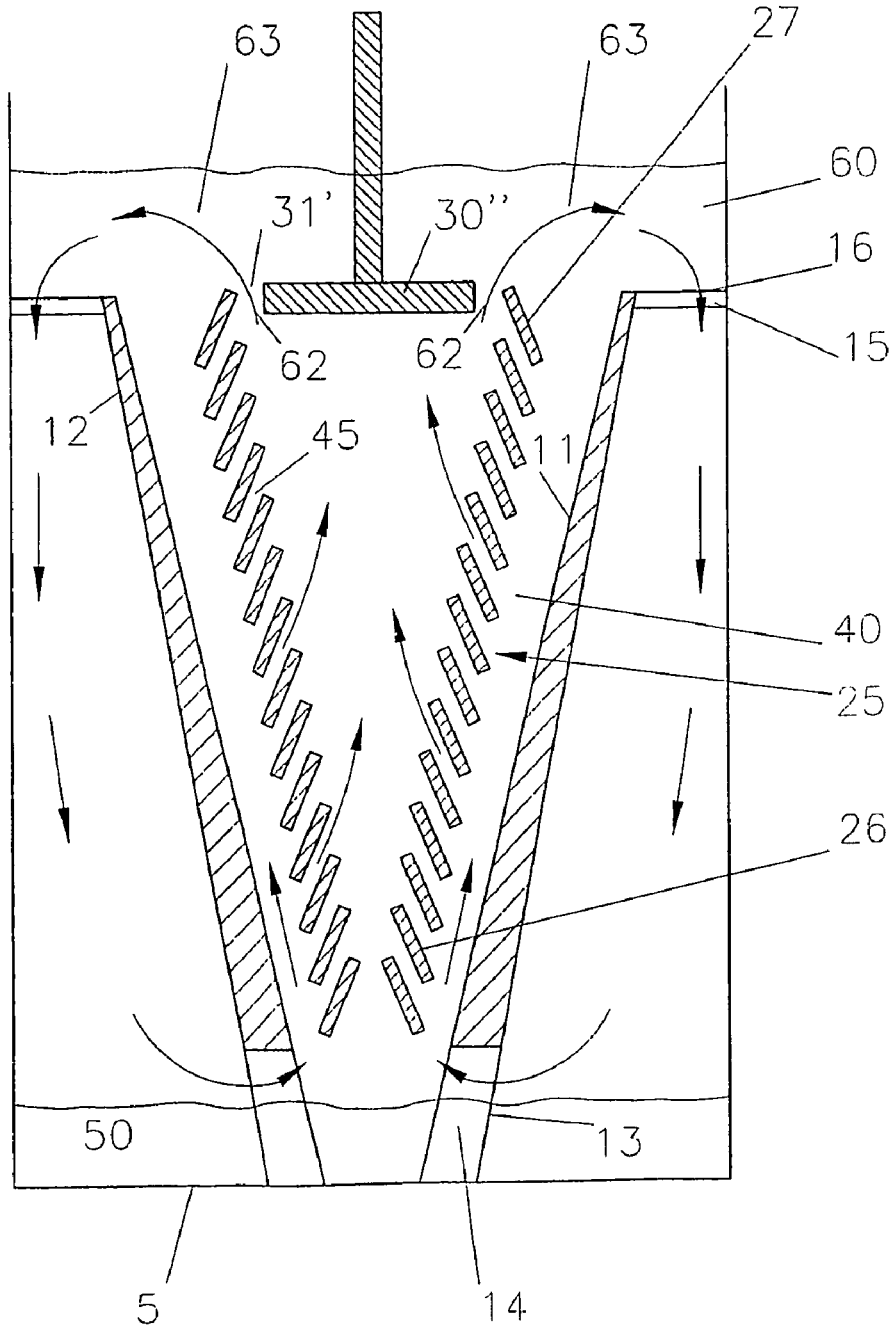
FIG. 3 shows a cross-sectional view of a drained-cathode cell according to the invention with vet another foraminate generally v-shaped oxygen-evolving anode.

FIG. 3, where the same reference numerals designate the same elements, shows another cell according to the invention in which the generally v-shaped grid-like anode structure 25 is made of a series of parallel spaced-apart horizontal blades 26 arranged like venetian blinds.

Furthermore the anode structure 25 is covered with an electrolyte guide member 30" in the shape of a plate placed in-between the upper ends 27 of the anode structure 25 leaving passages 31' between upper ends 27 and the guide member 30" for alumina-depleted electrolyte 60. In a variation, this guide member has a downwardly-oriented guide surface that has a general flattened u- or v-shape in cross-section leading to the passages 31'.

Figure 5:
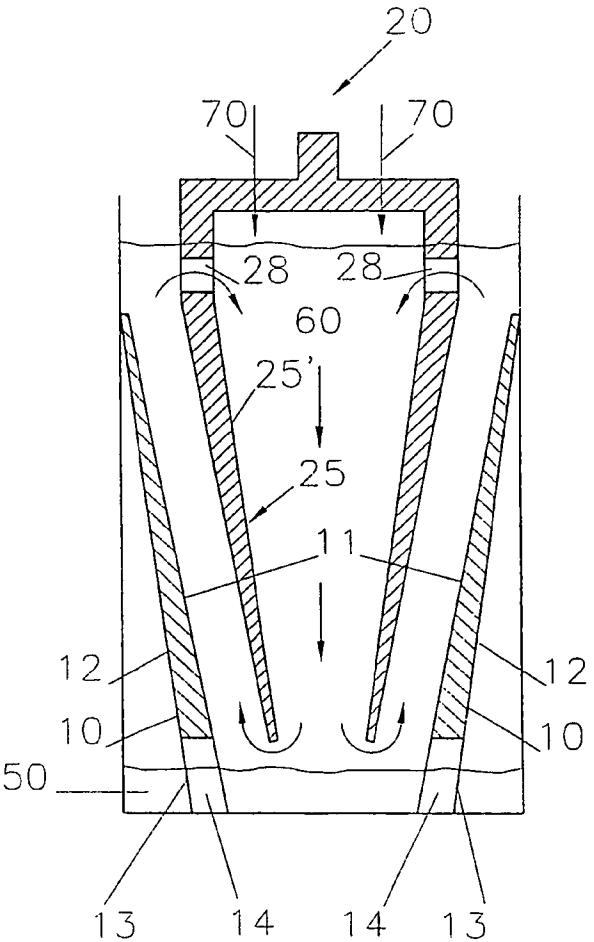
FIGS. 4 and 5 show cross-sectional views of drained-cathode cells according to the invention utilising oxygen-evolving solid anodic plates.
Figure 4:
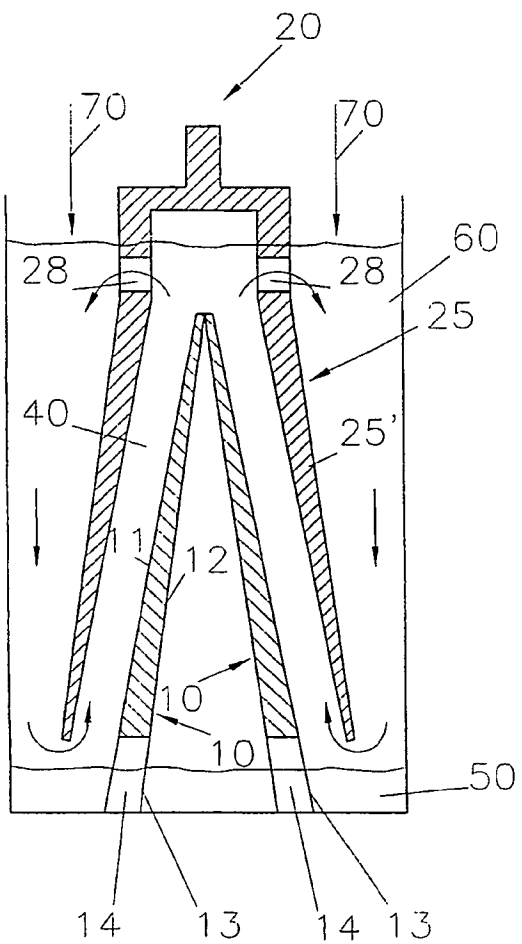

FIGS. 4 and 5, where the same reference numerals designate the same elements as before, disclose two aluminium production cells with inclined cathodic plates 10 according to the invention and anodes 20 having electrochemically active structures 25 made of inclined solid plates that are parallel to the upwardly-oriented cathode surfaces 11.

In cross-section, the cathodic plates 10 and the anode plates 25 shown in FIG. 4 are in an inverted v-shape arrangement, whereas the cathodic plates 10 shown in FIG. 5 are in a v-shape arrangement and the anode plates 25 form a v therebetween. The anode plates 25 are provided with openings 28 above the anode-cathode gap 40 for the circulation of electrolyte 60.

The anode plates 25 have a horizontal cross-section that varies along its length and is proportional to the anodic current passed therethrough, i.e. a decreasing horizontal cross-section with a decreasing amount of current (the plates 25 being downwardly tapered), to maintain a substantially uniform current density along the anode plates 25.

In operation, alumina is electrolysed in the anode-cathode gap 40 and oxygen released on the anode plates 25 in the gap 40 promotes an upward circulation along the entire anode-cathode gap 40 of the electrolyte 60 which is depleted in alumina. The electrolyte 60 returns from the upper end of the anode-cathode gap 40 through anode openings 28 and then down along an inactive surface 25' of the anode structure 25 to the bottom end of the anode cathode gap 40. Alumina is intermittently or continuously fed to the surface of the electrolyte 60, as indicated by arrow 70, whereby the electrolyte 60 is enriched with alumina while it returns to the bottom end of the anode cathode-gap 40.

In the cells of FIGS. 4 and 5, the electrolyte 60 does not circulate along the rear surface 11 of cathodic plates 10. Thus, the cathodic plates 10 do not need to be associated with a passage for the circulation of electrolyte 60. However, these plates 10 are provided with an opening in their bottom end 13 serving only for the passage of the aluminium pool 50.

Figure 6:
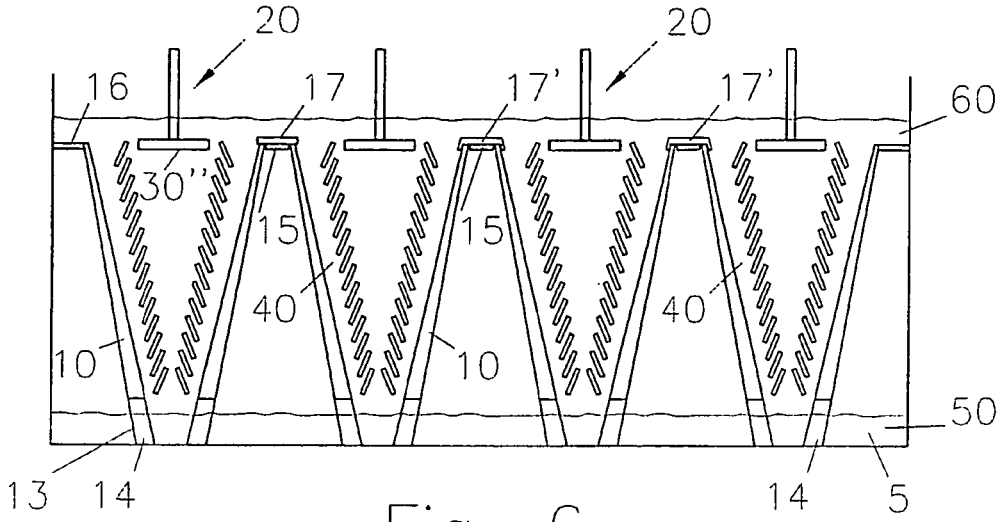
FIG. 6 shows a cross-sectional view of a drained-cathode cells according to the invention fitted with several anodes, enlarged views of different possibilities being shown in FIGS. 6*a* and 6*b*.
Figure 7:
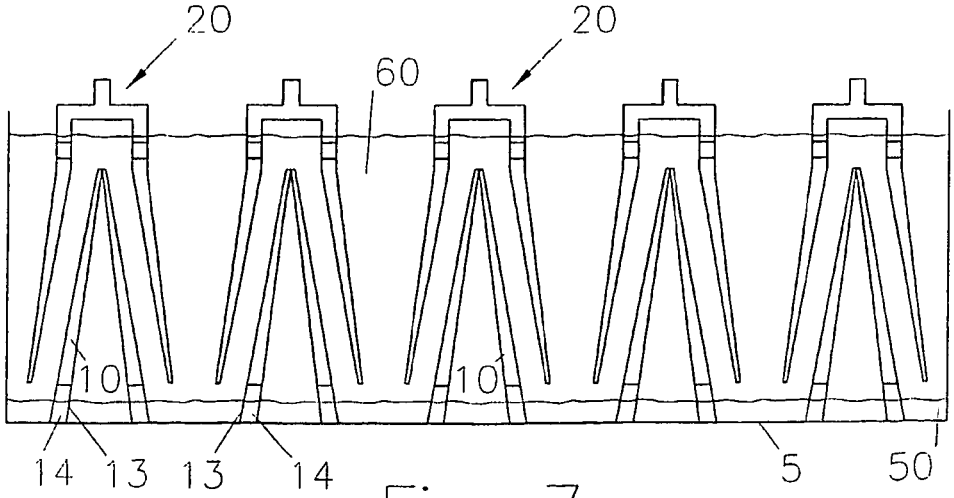
FIG. 7 shows a cross-sectional view of another drained-cathode cell according to the invention fitted with several anodes.

FIGS. 6 and 7, where the same reference numerals designate the same elements, show cells with several pairs of cathode plates 10 and several anodes 20. In FIG. 6, the cell is fitted with a series of anodes 20 of the type illustrated in FIG. 3 whereas in FIG. 7, the cell is fitted with a series of anodes of the type disclosed in FIG. 4.

The cells of FIGS. 6 and 7 have a series of side-by-side pairs of cathodic plates 10 in a v- or inverted v-shaped arrangement in cross-section.

The cell of FIG. 6 is fitted with foraminate anodes 20 as shown in FIG. 3. Alternatively, the anodes 20 can be substituted with the anodes shown in FIG. 1, 2 or 5.

Neighbouring upper edges of plates 10 are spaced apart by spacer members 17,17' leaving between them a passage 15 for the circulation of alumina-enriched electrolyte 60 to a bottom end of the anode-cathode gap 40.

Figure 6A:
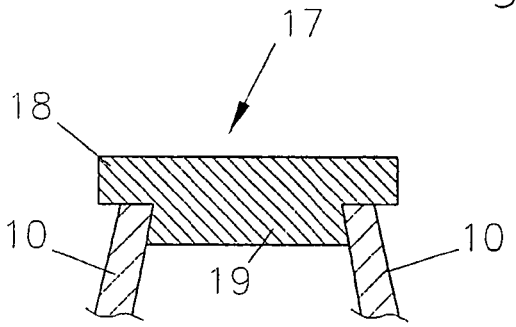

The spacer member 17 shown on the left-hand side of FIG. 6 and in FIG. 6*a* has horizontally extending upper flanges 18 on the upper edges of plates 10 and a central part 19 that holds the upper edges of plates 10 apart.

Figure 6B:
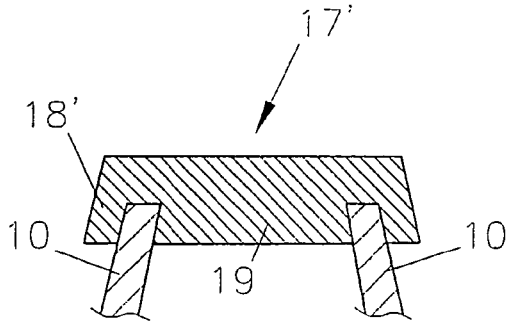

The spacer member 17' shown on the right-hand side of FIG. 6 and in FIG. 6*b* has flanges 18' that surround and secure the upper edges of plates 10 against the central spacing part 19.

The cell of FIG. 7 is fitted with plate anodes 20 as shown in FIG. 4. In this cell configuration, circulation of alumina-enriched electrolyte 60 takes place between the anodes 20 and no electrolyte passage is needed between the cathodic plates 10 whose upper edges are juxtaposed. However, in a variation, an electrolyte passage can also be provided between the cathodic plates in accordance with the teachings of WO01/31088 (de Nora).

Like in FIGS. 1 to 5, the bottom parts 13 of the cathodic plates 10 shown in FIGS. 6 and 7 are provided with an openings 14 for the passage of the aluminium pool 50.

The entire cell configurations or the cathodic arrangements shown in FIGS. 6 and 7 may be retrofitted into existing Hall-Héroult cells with corresponding anodes or may be used in cells of new design, in particular in cells operating at reduced temperatures, typically 850° to 940° C.

The cathodic plates 10 are, for instance, advantageously used to replace the solid cathode bodies of the cells disclosed in WO01/31088 (de Nora).

In commercial cells, for example as schematically shown in FIGS. 6 and 7, the level of the aluminium pool 50 may be allowed to fluctuate on the cell bottom or the aluminium may be collected, e.g. over a weir that sets a maximum level of the aluminium pool, in a separate collection reservoir of the aluminium production cell.

In a variation, the cathodic plates 10 shown in FIGS. 1 to 7 may be substituted with a series of parallel elongated cathodic members as mentioned above.

The invention claimed is:

1. A cell for the electrowinning of aluminium from alumina dissolved in a molten electrolyte, comprising a generally horizontal cell bottom on which a pool of product aluminium is collected and at least one electrically conductive cathodic element having one or more sloping upper aluminium-wettable drained active cathode surfaces separated by an anode-cathode gap from one or more anodes with corresponding sloping active anode surfaces, wherein the cathodic element comprises an inclined cathodic wall in the electrolyte above the generally horizontal cell bottom, the cathodic wall having:

a) an upwardly-oriented inclined face that forms the sloping upper aluminium-wettable drained active cathode surface(s) on which aluminium is produced and drains into the aluminium pool;

b) a downwardly-oriented inclined face which is in contact with the molten electrolyte and which overlies the aluminium pool;

c) a bottom end on the cell bottom in the aluminium pool; and d) a passage in a bottom part thereof for the aluminium pool and/or for a flow of alumina-rich electrolyte from behind the active cathode surface(s) to a bottom part of the anode-cathode gap, the aluminium pool covering substantially the entire cell bottom including underneath the cathodic wall.

2. The cell of claim 1, wherein the cathodic wall is made of a generally flat plate.

3. The cell of claim 2, wherein said plate comprises a plurality of sloping sections.

4. The cell of claim 3, wherein said plate has an inverted v-shape in cross-section.

5. The cell of claim 1, wherein the cathodic wall is made of a series of spaced apart generally parallel elongated cathodic members.

6. The cell of claim 1, wherein the cathodic wall is generally conical or pyramidal.

7. The cell of claim 1, wherein the cathodic wall has an upper end that delimits a passage for the flow of electrolyte from above an upper part of the anode-cathode gap to behind the active cathode surface(s).

8. The cell of claim 1, wherein the cathodic wall comprises an opening in a top part thereof for the flow of electrolyte from above an upper part of the anode-cathode gap to behind the active cathode surface(s).

9. The cell of claim 1, wherein at least one anode comprises an electrochemically active foraminate metallic anode structure for the evolution of oxygen, the foraminate anode structure comprising through openings for the circulation of electrolyte therethrough.

10. The cell of claim 9, which comprises at least one electrolyte guide member located above said foraminate anode structure for guiding the circulation of electrolyte.

11. The cell of claim 9, wherein said foraminate anode structure is v-shaped in cross-section and faces a corresponding v-shaped active cathode surface.

12. The cell of claim 11, which comprises an electrolyte guide member located above an upper end of said v-shaped foraminate anode structure and which extends over substantially the entire area of the v-shaped anode structure for guiding an up-flow of alumina-depleted electrolyte from the anode's through-openings to a location above the anode structure where the electrolyte is enriched with alumina and then over an upper end of the generally v-shaped anode structure from where the alumina-enriched electrolyte is fed into the anode-cathode gap.

13. The cell of claim 1, comprising at least one non-foraminate anode having an electrochemically active metallic anode structure made of one or more solid plates facing an active cathode surface.

14. The cell of claim 13, wherein said anode structure comprises an upper end that delimits a passage for the circulation of electrolyte above the anode structure.

15. The cell of claim 13, wherein said anode structure comprises an upper part with an opening that delimits a passage for the circulation of electrolyte through the anode structure.

16. The cell of claim 1, which comprises a cell bottom of a refurbished cell retrofitted with said cathodic wall.

17. The cell of claim 1, wherein the cathodic wall is made of an aluminium-wettable openly porous ceramic material which is mechanically and chemically resistant and which is filled with molten aluminium.

18. The cell of claim 17, wherein the aluminium-wettable openly porous walls contains an aluminium-wetting agent that is reactable with molten aluminium to form a surface layer containing alumina, aluminium and metal derived from the metal oxide and/or partly oxidised metal, such as manganese, iron, cobalt, nickel, copper, zinc, molybdenum, lanthanum or other rare earth metals or combinations thereof.

19. The cell of claim 17, wherein the cathodic aluminium-wettable openly porous ceramic material comprises at least one of: oxides of aluminium, zirconium, tantalum, titanium, silicon, niobium, magnesium and calcium; nitrides, carbides and borides and oxycompounds thereof.

20. A method of electrowinning aluminium in a cell as defined in claim 1, comprising electrolysing in the anode-cathode gap alumina dissolved in the molten electrolyte to produce gas anodically and aluminium on the upwardly-oriented inclined active cathode surface(s) of the cathodic wall(s), the product aluminium draining from the active cathode surface(s) and being collected on the cell bottom in the aluminium pool.

* * * * *